US009909325B2

(12) United States Patent
Marcon

(10) Patent No.: US 9,909,325 B2
(45) Date of Patent: Mar. 6, 2018

(54) MECHANISM FOR FASTENING IN A SWIVELLING MANNER A PLATE CARRIER TO A TELESCOPIC MAST OF A PLATE-LIFTING APPARATUS, AND PLATE-LIFTING APPARATUS EQUIPPED WITH THIS MECHANISM

(71) Applicant: ÉTABLISSEMENTS PIERRE GRÉHAL ET CIE SA, Baillet en France (FR)

(72) Inventor: Lionel Marcon, Parmain (FR)

(73) Assignee: ETABLISSEMENTS PIERRE GREHAL ET CIE SA, Baillet-en-France (FR)

( * ) Notice: Subject to any disclaimer, the term of this patent is extended or adjusted under 35 U.S.C. 154(b) by 0 days.

(21) Appl. No.: 15/523,684

(22) PCT Filed: Oct. 2, 2015

(86) PCT No.: PCT/FR2015/052660

§ 371 (c)(1),
(2) Date: May 2, 2017

(87) PCT Pub. No.: WO2016/071590

PCT Pub. Date: May 12, 2016

(65) Prior Publication Data

US 2017/0335578 A1 Nov. 23, 2017

(30) Foreign Application Priority Data

Nov. 6, 2014 (FR) ..... 14 60721

(51) Int. Cl.
*E04F 21/18* (2006.01)

(52) U.S. Cl.
CPC ..... *E04F 21/18* (2013.01); *E04F 21/1822* (2013.01)

(58) Field of Classification Search
CPC ... E04F 21/18; E04F 21/1822; E04F 21/1811; E04F 21/1805

(Continued)

(56) References Cited

U.S. PATENT DOCUMENTS 2,472,944 A * 6/1949 Furer ..... B66F 11/048 182/2.7
3,643,935 A * 2/1972 Bell ..... B25H 1/00 108/8

(Continued)

FOREIGN PATENT DOCUMENTS

EP 1 536 084 6/2005
EP 1 640 531 3/2006

(Continued)

*Primary Examiner* — Brian E Glessner
*Assistant Examiner* — Adam G Barlow
(74) *Attorney, Agent, or Firm* — Clark & Brody

(57) ABSTRACT

A reliable swiveling fastening mechanism that allows a plate to be horizontally, obliquely and vertically fastened comprises, in the position of use: a vertical supporting profile to be arranged at the top of the mast, coaxially to the mast; two parallel backing plates mounted so as to swivel on the supporting profile and interconnected on one side by a plate carrier fastening component and on the other side by a U-shaped vertical position stop attached to the backing plates and arranged in such a way that the plate carrier fastening component is parallel to the supporting profile when the supporting profile is in contact with the vertical position stop; and a retractable stop supported by at least one backing plate so that the plate carrier fastening component forms an angle between 10° and 80° with the supporting profile when the supporting profile is in contact with the retractable stop.

10 Claims, 1 Drawing Sheet

(58) Field of Classification Search
USPC ..... 52/116–119, 122.1, 127.2, 749.1; 414/10, 11
See application file for complete search history.

(56) References Cited

U.S. PATENT DOCUMENTS 5,305,576 A * 4/1994 Giles ..... E04B 1/3211 249/209
5,700,123 A * 12/1997 Rokosh ..... E04F 21/1811 414/11
5,704,755 A * 1/1998 Jesperson ..... B66C 23/48 414/10
6,176,063 B1 * 1/2001 Warin ..... E04F 21/1811 52/749.1
6,241,447 B1 * 6/2001 Echternacht ..... B62B 3/108 280/79.7
6,244,810 B1 * 6/2001 Reyes ..... E04F 21/1811 254/4 C
7,448,606 B1 * 11/2008 Johnson ..... B05B 13/0285 269/16
9,334,663 B2 * 5/2016 Galvez ..... E04F 21/1811
2005/0217157 A1 * 10/2005 Valette ..... E04F 21/1822 40/650
2008/0008561 A1 * 1/2008 Hontz, Jr. ..... E04F 21/1822 414/11
2013/0343833 A1 * 12/2013 Mullins ..... E04G 21/168 414/11
2014/0294540 A1 * 10/2014 Shaw ..... B66C 23/48 414/11
2015/0211242 A1 * 7/2015 Rosati ..... E04G 21/3247 414/10

FOREIGN PATENT DOCUMENTS

EP 1 783 301 5/2007
FR 2 538 437 6/1984
FR 2 552 478 3/1985

* cited by examiner

Fig. 1
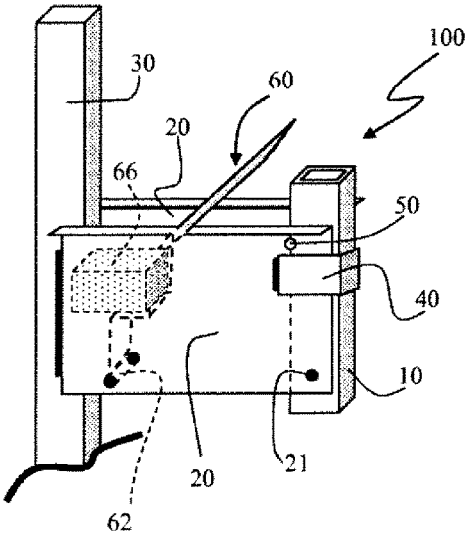
Fig. 2
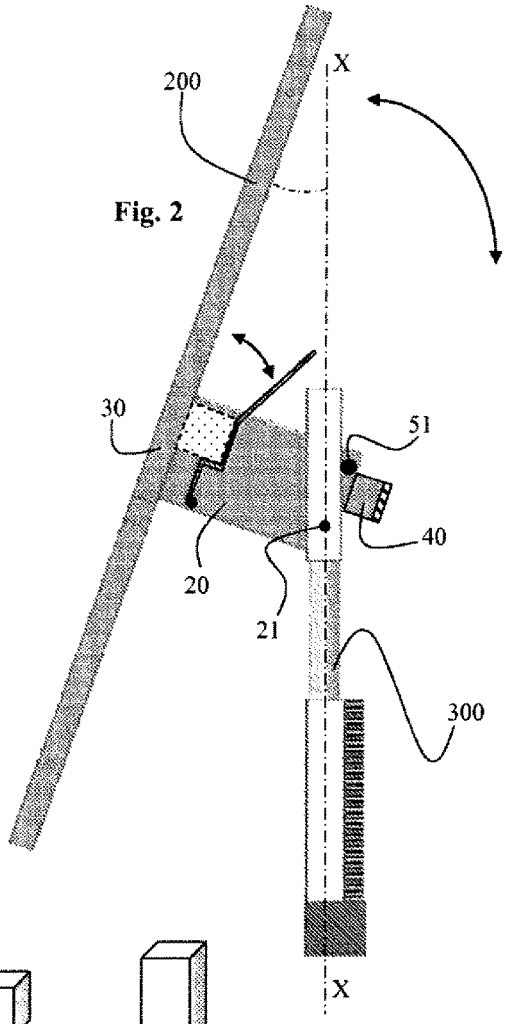
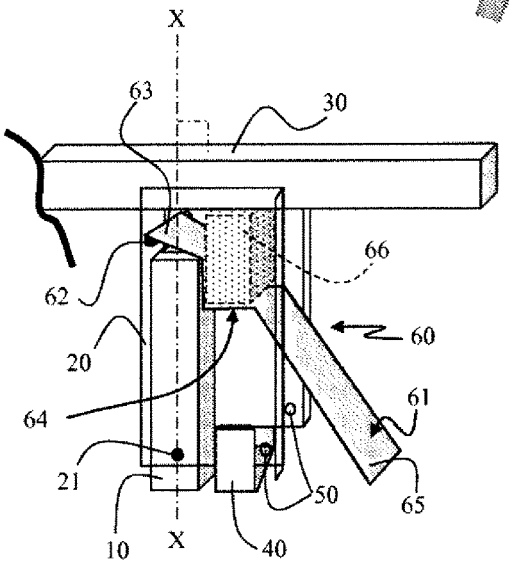
Fig. 3
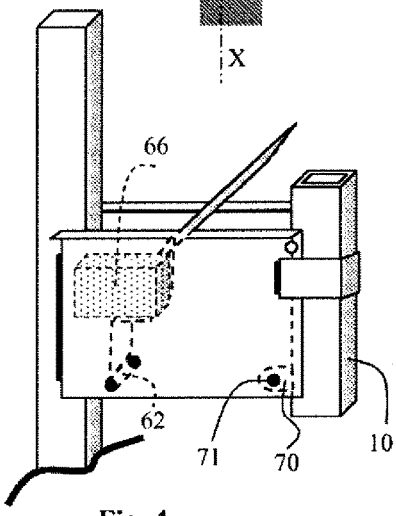
Fig. 4

MECHANISM FOR FASTENING IN A SWIVELLING MANNER A PLATE CARRIER TO A TELESCOPIC MAST OF A PLATE-LIFTING APPARATUS, AND PLATE-LIFTING APPARATUS EQUIPPED WITH THIS MECHANISM

The invention concerns a swiveling fastening mechanism of a plate carrier on a telescopic mast of a plate-lifting apparatus, as well as a plate-lifting apparatus equipped with such a mechanism.

In particular, the invention concerns lifting and handling apparatus used during work for the manipulation and positioning of heavy objects, such as plates of material (plasterboard, wooden panels, etc.) in order to make false ceilings or for construction at a slant or on a partition.

This type of apparatus, known as a plate lifter, has already been described for example in the document FR2538437.

The general structure of a plate lifter is as follows: a telescopic mast, controllable by a lifting mechanism, is mounted on a rolling base. A plate carrier is mounted in a swiveling manner at the end of the mast by means of a swivel mechanism.

The telescopic mast comprises a first fixed element, and at least one mobile element which is telescopic in relation to the fixed element. Generally, the mast comprises two mobile telescopic elements.

The majority of the existing plate lifters (such as the one in document EP1783301) comprise a swiveling fastening mechanism enabling only two positions of use of the plate carrier:

- a first so-called "horizontal" position in which the plate carrier is substantially parallel with the ground, and thus forms an angle of 90° with the telescopic mast. This position enables the fastening of plates such as a horizontal false ceiling; and
- a second so-called "angled" position in which the plate carrier forms an angle with the mast of less than 90°, typically between 10° and 80°. This position on the one hand allows loading of the plate carrier, that is, positioning a plate on the plate carrier, but also fastening of plates on arched walls, that is, on the interior frame of a sloping ceiling.

However, this mechanism does not allow a fastening of plates vertically. Moreover, it is quite bulky and its locking mechanism is accessible to one hand during the tilting and thus it constitutes a risk of injury.

In order to propose a plate lifter enabling the vertical fastening of a plate, a pivoting mechanism has been proposed comprising the vertical backing plates equipped with curved oblong apertures enabling a continuous or discontinuous guidance of the horizontal to the vertical.

Document EP1536084 describes such a mechanism. In this mechanism, the axis of rotation is shifted by several centimeters in relation to the shaft in order to allow the vertical tilting. However, the stresses on the pivoting mechanism are very sizeable due to the leverage effect created by the weight of the plate. It must therefore be very sturdy and is generally made of very thick metal sheets, often combined with reinforcements. Moreover, this pivoting mechanism is hardly practical, since the locking system is a bolt passing through the oblong apertures, which needs to be unscrewed while holding the plate carrier so that it does not tilt at the wrong time.

It has thus been proposed to equip such a mechanism with a centralized unlocking device, in the form of a handle. This mechanism is described in document EP1640531. However, this mechanism is very complex and costly, and the movement needed to unlock and tilt the plate at the same time strains the user's back. Furthermore, the strength problem is worse, since the pivoting axis must also bear the entire handle mechanism. Finally, it does not solve the problem of the accessibility of the locking system.

Thus, the present invention aims to propose a reliable swiveling fastening mechanism, one which is safe (that is, limiting the risks of injury to the user), economical in material, ergonomic, multi-use (i.e., allowing a horizontal, angular, and vertical fixation of a plate), and easy to maintain.

Toward this end, the invention proposes a mechanism hinged to the mast or in its immediate proximity, comprising two end stops against the mast: one retractable stop of angled position and one fixed stop of vertical position, and in which the locking device tilts at the same time as the mechanism, so that it is not accessible to the user's hand.

Thus, the subject matter of the invention is a swiveling fastening mechanism for a plate carrier on a telescopic mast of a plate lifting apparatus, comprising, with reference to the position of use:

- a vertical supporting profile to be arranged at the top of the mast, coaxially to the mast;
- two parallel backing plates mounted so as to swivel on the supporting profile, and interconnected on one side by a fastening component of the plate carrier and on the other side by a U-shaped stop, called "vertical position" stop attached to the backing plates and arranged in such a way that the fastening component of the plate carrier is parallel to the supporting profile when the supporting profile is in contact with the vertical position stop;
- a retractable stop supported by at least one backing plate in such a way that the fastening component of the plate carrier forms an angle between 10° and 80° with the supporting profile when the supporting profile is in contact with the retractable stop.

According to other embodiments:

- the two parallel backing plates can be mounted pivoting on the supporting profile by an axis passing through the supporting profile;
- the supporting profile may comprise two outside bearings, the two parallel backing plates being mounted pivoting on the bearings by an axis passing through the two bearings;
- the mechanism may comprise in addition a locking pawl mounted pivoting between the two backing plates, this pawl comprising:
  - a handle having:
    - a first end equipped with an axis of rotation of the pawl, engaged in each of the backing plates;
    - a V-shaped part designed to cooperate by locking with the supporting profile;
    - a second end constituting an unlocking handle for the pawl;
  - an elastic return means disposed between the pawl and the fastening component of the plate carrier, allowing the pivoting of the pawl when the V-shaped part slides against the tubular supporting profile during a pivoting of the fastening component into a horizontal position, and the return of the pawl to a locking position when the fastening component of the plate carrier is in horizontal position;
- in locking position, the V-shaped part of the pawl can cooperate with the supporting profile by engaging in the interior aperture of the supporting profile if the latter is tubular, in locking position, the V-shaped part of the pawl can cooperate with the supporting profile by locking behind the supporting profile in relation to the pivoting axis of the pawl.

the elastic return means can be chosen between a spring and a foam rubber block.

a plate carrier can be welded to the fastening component of the plate carrier.

the fastening component of the plate carrier comprises removable means of fastening of a plate carrier.

The invention likewise relates to a lifting apparatus for lifting a construction plate, characterized in that it comprises:

A mast provided with a lifting mechanism;

A rolling base secured to a first end of the mast;

A swiveling fastening mechanism as per the above;

A plate carrier secured to the swiveling fastening mechanism.

Other characteristics of the invention shall be mentioned in the following detailed description making reference to the enclosed drawings, which show respectively:

FIG. 1, a schematic perspective view of a swiveling fastening mechanism according to the invention in vertical position;

FIG. 2, a schematic perspective view of a swiveling fastening mechanism according to the invention in angled position, mounted on a mast of a lifting apparatus;

FIG. 3, a schematic perspective view of the swiveling fastening mechanism of FIG. 1 in horizontal position; and FIG. 4, a schematic perspective view of one variant of the swiveling fastening mechanism of FIG. 1 in vertical position.

FIG. 1 illustrates a first embodiment of a swiveling fastening mechanism 100 designed to secure a plate carrier 200 (see figure two) on a telescopic mast 300 of a lifting apparatus for plates of material, particularly intended for construction.

According to the invention, the swiveling fastening mechanism 100 comprises, with reference to the position of use, a vertical supporting profile 10, designed to be positioned at the top of the mast 300 coaxially to the axis XX of the mast. The supporting profile 10 can advantageously be a tubular sleeve comprising an end stop for locking on the mast 300. Advantageously, this tubular sleeve is square or rectangular in shape in order to allow the locking of a locking pawl described in further detail afterwards.

The swiveling fastening mechanism 100 likewise comprises two parallel backing plates 20, mounted pivoting on the supporting profile 10 by an axis of rotation 21.

The two parallel backing plates 20 are interconnected on the one hand by a fastening component 30 of a plate carrier 200 and on the other hand by a U-shaped stop 40 called "vertical position" stop, welded to the backing plates 20. The vertical position stop 40 is arranged so that the fastening component 30 of the plate carrier 200 is parallel to the supporting profile 10 when the latter is in contact with the vertical position stop 40.

Thus, in this position, the plate carrier is in vertical position and it is possible to transport, lift and attach a plate against a vertical support, such as a wall.

Moreover, the vertical position stop 40 bears directly against the vertical supporting profile and thus against the mast, which ensures a good stability for the assembly, unlike the system of the prior art in which the vertical position stop is offset in regard to the axis of the mast.

In order to allow a positioning of the swiveling fastening mechanism at an angle greater than 0° and less than 90° in relation to the axis XX of the mast, the fastening mechanism according to the invention comprises a retractable stop 50 carried by at least one backing plate such that the fastening component 30 of the plate carrier forms an angle between 10° and 80° with the supporting profile when the supporting profile is in contact with the retractable stop 50.

In the embodiment illustrated, the retractable stop is comprised of two holes 50 situated opposite each other and each one being carried by a backing plate 20 so that when a pin 51 (illustrated in cross section in FIG. 4) is positioned through the holes 50, the fastening component 30 of the plate carrier makes an angle between 10° and 80° with the supporting profile 10, that is, with the axis XX of the mast 300.

In the embodiment of FIGS. 1 to 3, the two backing plates 20 are mounted pivoting on the supporting profile 10 by an axis 21 passing through the supporting profile.

Advantageously, the axis 21 intersects the axis XX, making it possible to center the weight during the lifting and preventing the mast from having a deflection when it is upright with wallboard plates located on the plate carrier.

FIG. 2 illustrates the swiveling fastening mechanism according to the invention in place on a telescopic mast of a plate carrier.

In this figure, the backing plate 20 in the foreground has been omitted in order to clarify the internal structure of the swiveling fastening mechanism according to the invention.

In FIG. 2, the swiveling fastening mechanism is pivoted in relation to the vertical position of FIG. 1, so that the fastening component of the plate carrier and the plate carrier 200 itself are no longer parallel to the mast but instead make an angle between 10 and 80 degrees with the axis XX of the mast. A pin 51 is placed in removable manner in the holes 50 so as to hold the plate carrier in this position.

This position allows both a positioning of a plate on the plate carrier 200 and a fastening of a plate of material on a sloping support such as an arched wall.

FIG. 3 illustrates the swiveling fastening mechanism of FIG. 1 in horizontal position, that is, the fastening component 30 of the plate carrier and the plate carrier 200 itself are horizontal and make an angle of 90° with the supporting profile 10 and thus with the axis XX of the mast 300.

This position allows a fastening of a plate to a horizontal support such as a metal reinforcement of a false ceiling.

In order to hold the plate carrier in this horizontal position, the invention proposes equipping the swiveling fastening mechanism with a locking pawl 60 mounted pivoting between the two backing plates 20.

This pawl 60 comprises a handle 61 articulated between the backing plates 20 by a pivot 62.

In particular, the handle 61 comprises a first end 63 provided with an axis of rotation 62 engaged in each of the backing plates 20, a V-shaped part 64 designed to cooperate by locking with the supporting profile 10, and a second end 65 constituting a grasping handle for unlocking the pawl 60.

The handle 61 likewise comprises, at the bottom of the V-shaped part 64, an elastic return means 66 arranged between the pawl and the fastening component 30 of the plate carrier.

The V-shape of the pawl 60 allows the pawl to slide automatically against the tubular supporting profile 10 when the fastening mechanism is tilted into the horizontal position. The elastic return means 66 pushes the pawl back into a locking position when the fastening component 30 of the plate carrier is in horizontal position. In this position, depending on the shape of the pawl chosen by the manufacturer and in particular that of the V-shaped part 64, the V-shaped part is designed either to become locked inside the internal aperture of the tubular supporting profile 10 or to become locked behind the supporting profile 10 (as illustrated in FIG. 3) with respect to the axis of rotation 51, thus locking the mechanism in horizontal position.

The elastic means of return can be a compression spring.

According to one advantageous embodiment of the invention, the elastic means of return is a foam rubber block whose stiffness is chosen to ensure the return of the pawl to the locking position and a comfortable manual unlocking for the users.

The use of a foam rubber block is advantageous, since it is not possible to get one's fingers pinched inadvertently. Moreover, if this foam rubber block is damaged, it is very easy and economical to replace it.

An alternative embodiment is illustrated in FIG. 4 where the supporting profile comprises two outside bearings 70, the parallel backing plates 20 being mounted pivoting on the bearings 70 by an axis 71 passing through the two bearings.

In this embodiment, the distance of the axis of rotation 71 in relation to the supporting profile is chosen such that the axis 71 is as close as possible to the supporting profile.

In all of the embodiments of the invention, the plate carrier 200 may be either welded to the fastening component of the plate carrier or secured in removable manner to the fastening component 30 of the plate carrier. In this latter embodiment, it is thus possible to remove the plate carrier during the dismantling and then remove the swiveling fastening mechanism to limit the weight lifted by the user during each operation.

The device according to the invention enables a vertical pivoting. It is not bulky, and it is safe (the locking pawl is between the two backing plates and pivots at the same time), simple and robust (no oblong apertures in the backing plates liable to weaken the strength of the backing plates). Furthermore, it allows great stability since the pivoting is done as close as possible to the mast, or even on the mast.

The invention claimed is:

1. A swiveling fastening mechanism (100) for a plate carrier (200) on a telescopic mast (300) of a plate lifting apparatus, characterized in that it comprises, with reference to the position of use:

a vertical supporting profile (10) to be arranged at the top of the mast, coaxially to the mast;

two parallel backing plates (20) mounted so as to swivel on the supporting profile (10), and interconnected on one side by a fastening component (30) of the plate carrier (200) and on the other side by a U-shaped stop (40), called vertical position stop, attached to the backing plates and arranged in such a way that the fastening component (30) of the plate carrier is parallel to the supporting profile (10) when the supporting profile is in contact with the vertical position stop (40);

a retractable stop (50) supported by at least one backing plate in such a way that the fastening component (30) of the plate carrier forms an angle between 10° and 80° with the supporting profile when the supporting profile is in contact with the retractable stop (50).

2. The mechanism as claimed in claim 1, wherein the two parallel backing plates are mounted pivoting on the supporting profile (10) by an axis (21) passing through the supporting profile.

3. The mechanism as claimed in claim 1, wherein the supporting profile comprises two outside bearings (70), the two parallel backing plates being mounted pivoting on the bearings by an axis (71) passing through the two bearings.

4. The mechanism as claimed in claim 1, furthermore comprising a locking pawl (60) mounted pivoting between the two backing plates, this pawl comprising:

a handle (61) having:

a first end (63) equipped with an axis of rotation (62) of the pawl, engaged in each of the backing plates;

a V-shaped part (64) designed to cooperate by locking with the supporting profile (10);

a second end (65) constituting an unlocking handle for the pawl;

an elastic return means (66) disposed between the pawl and the fastening component (30) of the plate carrier, allowing the pivoting of the pawl when the V-shaped part slides against the tubular supporting profile during a pivoting of the fastening component (30) into a horizontal position, and the return of the pawl to a locking position when the fastening component (30) of the plate carrier is in horizontal position.

5. The mechanism as claimed in claim 4, wherein, in locking position, the V-shaped part of the pawl cooperates with the supporting profile by engaging in the interior aperture of the supporting profile if the latter is tubular.

6. The mechanism as claimed in claim 4, wherein, in locking position, the V-shaped part of the pawl cooperates with the supporting profile by locking behind the supporting profile in relation to the pivoting axis of the pawl.

7. The mechanism as claimed in claim 4, wherein the elastic return means (66) is chosen between a spring and a foam rubber block.

8. The mechanism as claimed in claim 1, wherein a plate carrier is welded to the fastening component of the plate carrier.

9. The mechanism as claimed in claim 1, wherein the fastening component of the plate carrier comprises removable means of fastening of a plate carrier.

10. Lifting apparatus for lifting a construction plate, characterized in that it comprises:

a mast provided with a lifting mechanism, a rolling base secured to a first end of the mast;

a swiveling fastening mechanism as claimed in claim 1 a plate carrier secured to the swiveling fastening mechanism.

* * * * *